United States Patent [19]

Vegter et al.

[11] Patent Number: 4,970,431

[45] Date of Patent: Nov. 13, 1990

[54] HIGH-PRESSURE SODIUM DISCHARGE LAMP WITH FINS RADIALLY EXTENDING FROM THE DISCHARGE VESSEL FOR CONTROLLING THE WALL TEMPERATURE OF THE DISCHARGE VESSEL

[75] Inventors: Klaas Vegter, New York, N.Y.; Johannes H. M. van der Sande, Eindhoven, Netherlands

[73] Assignee: U.S. Philips Corporation, New York, N.Y.

[21] Appl. No.: 263,097

[22] Filed: Oct. 26, 1988

[30] Foreign Application Priority Data

Nov. 3, 1987 [NL] Netherlands ..... 8702616

[51] Int. Cl.[5] ..... H01J 17/28; H01J 61/52

[52] U.S. Cl. ..... 313/634; 313/44

[58] Field of Search ..... 313/634, 43, 44, 45

[56] References Cited

U.S. PATENT DOCUMENTS

| | | | |
|---|---|---|---|
| 3,790,837 | 2/1974 | Timmermans | 313/44 |
| 4,594,529 | 6/1986 | de Vrijer | 313/634 X |
| 4,795,943 | 1/1989 | Antonis et al. | 313/623 |

FOREIGN PATENT DOCUMENTS 2083281 3/1982 United Kingdom .

*Primary Examiner*—Sandra L. O'Shea

*Attorney, Agent, or Firm*—Brian J. Wieghaus

[57] ABSTRACT

A high-pressure sodium discharge lamp having a nominal power of at most 50 W provided with an elongate ceramic lamp vessel, which has over a length L an at least substantially constant inner diameter $\phi$ and a substantially constant wall thickness d, in which discharge vessel electrodes are arranged with their tips opposite to each other at a relative distance D. During operation, the lamp emits light having a color temperature of at least 2250K. According to the invention, it holds that $D/L \leqq 0.5$ and $(\phi+d) \leqq 2.5$ mm, while the discharge vessel is in mechanical contact with a substantially radially extending molding.

17 Claims, 3 Drawing Sheets

HIGH-PRESSURE SODIUM DISCHARGE LAMP WITH FINS RADIALLY EXTENDING FROM THE DISCHARGE VESSEL FOR CONTROLLING THE WALL TEMPERATURE OF THE DISCHARGE VESSEL

BACKGROUND OF THE INVENTION

The invention relates to a high-pressure sodium discharge lamp having a nominal power of at most 50 W provided with an elongate ceramic discharge vessel which has over a length L an at least substantially constant inner diameter $\phi$ and a substantially constant wall thickness d and in which electrodes are arranged with their tips opposite to each other at a relative distance D, each electrode being connected to a respective current supply conductor, which is passed to the exterior near an end of the discharge vessel, this lamp emitting during operation light having a color temperature of at least 2250K.

Such a lamp is known from British Patent Specification No. 2,083,281. The term "ceramic discharge vessel" is to be understood to mean a discharge vessel having a wall consisting of monocrystalline metal oxide (for example sapphire) or polycrystalline metal oxide (for example: densely sintered aluminium oxide, densely sintered aluminium-yttrium-garnet). The known lamp can be used to replace an incandescent lamp. The lamp emits during operation "white light", of which it holds for the color temperature Tc that $2250K \leqq Tc \leqq 2750K$ and of which it holds for the general color index $Ra_8$ that $Ra_8 \geqq 60$. The region in the color triangle of the CIE chromaticity diagram within which the light of a high-pressure discharge lamp is designated as "white" is limited by straight lines through points with coordinates (x,y): (0.468; 0.430), (0.510; 0.430), (0.485; 0.390) and (0.445; 0.390). More stringent standards based on a value of the general color index $Ra_8 \geqq 75$ correspond in the color triangle to the region enclosed by the lines $x=0.468$, $x=0.490$, $y=0.408$ and $y=0.425$.

Lamps of this kind are suitable to replace incandescent lamps because of their longer life and their considerably higher efficiency.

In case the lamp replacing an incandescent lamp is used in a reflector luminaire, it is necessary that the optical dimensions of the discharge arc, viewed through the wall of the discharge vessel, are at least of substantially the same size as the dimensions of the helical filament of the replaced incandescent lamp. When the dimensions of the discharge arc of the known lamp are further reduced, this has the disadvantage that the efficiency of a lamp of this kind decreases or that the lamp is overloaded, as a result of which the life is shortened.

SUMMARY OF THE INVENTION

The invention has for its object to provide a lamp of the kind mentioned in the opening paragraph, which has smaller dimensions of the discharge arc of the known lamp at a given color temperature and a given power, while maintaining the efficiency.

According to the invention, this object is achieved in a lamp of the kind mentioned in the opening paragraph in that $D/L \leqq 0.5$, in that $(\phi+d) \leqq 2.5$ mm and in that the discharge vessel is in mechanical contact with a substantially radially extending molding or fin.

The lamp according to the invention generally has a nominal power lying between 20 W and 50 W. Lamps having a considerably lower nominal power can be obtained only with difficulty with means known hitherto. In order to avoid very high currents, D is at least 3 mm. On the other hand, the concentrability is adversely affected if D is very long. The electrode distance therefore lies generally between 3 mm and 13 mm. The ratio D/L generally lies between 0.15 and 0.5. With smaller ratios, loss of efficiency occurs due to losses at the electrodes.

BRIEF DESCRIPTION OF THE DRAWINGS

The inner diameter of the discharge vessel generally lies between 2.1 mm and 1.5 mm and the wall thickness d between 0.2 mm and 0.45 mm. When the inner diameter is further reduced, it can be avoided only at the expense of efficiency losses that the thermal load of the wall becomes inadmissibly high. Reduction of the wall thickness also influences the thermal load of the wall. Further, a wall thickness smaller than 0.2 mm can be obtained only with difficulty by present day production means.

In the lamp according to the invention, the maximum wall temperature remains limited with nominal load to 1570K. Preferably, the maximum wall temperature remains limited to 1530K.

Figure 1:
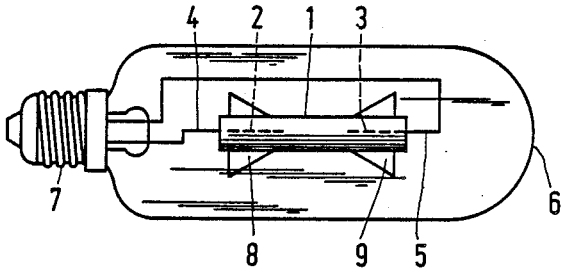

The molding or fin may be made of heat-resistant metal, such as tantalum and tungsten. In order to obtain a good mechanical contact, it is advantageous if such a molding forms part of a heat-resistant shield arranged to surround the wall of the discharge vessel. The shield and the molding may be made of bare metal. However, they may also be coated entirely or in part with a dark, for example black layer. A further improvement can be attained if the molding behaves like a black body for infrared radiation.

In general, the shield extends along part of the circumference of the discharge vessel, which is located between an end and an adjacent electrode tip.

Since for the optical dimensions of the discharge arc only the part of the discharge vessel between the tips of the electrodes is of importance, the heat-resistant shield can extend without any objection to the adjacent electrode tip. In order to prevent interaction with the light beam to be formed, the foremost boundary of the molding can enclose an acute angle in radial direction with the longitudinal axis of the discharge vessel.

A uniform temperature control along the circumference of the discharge vessel is favored in case the discharge vessel is provided with two or more radially extending moldings, which are arranged symmetrically to the longitudinal axis of the discharge vessel.

Depending upon the envisaged application, the discharge vessel may be provided at both ends with a heat-resistant shield each connected to one or more radially extending moldings.

The shape of the moldings will then also depend upon the beam shape to be produced.

In a lamp according to the invention, in order to promote heat dissipation, the measure in accordance with the invention can be combined with an already known measure to arrange the discharge vessel in an outer envelope filled with an inert gas. In practice, the dimensions of the outer envelope are chosen to be small. This is conducive to the usability in different reflectors. However, the volume available of the outer envelope is thus limited. On the other hand, in general the pressure of the inert gas at room temperature is chosen for consideration of safety to be not higher than about 1 bar.

Consequently however, the useful effect of this measure is comparatively small in practice.

It is known from literature to drive lamps into a high ambient temperature by a local forced cooling of the lamp vessel by means of a cooling liquid circuit. This method is comparatively expensive and is particularly unpractical for the field of use of the lamp according to the invention.

Although the thermal load of the wall of the discharge vessel can be reduced by thickening of the wall, this step has disadvantages. On the other hand, the light emitted by the discharge arc is more strongly scattered in the case of a thicker wall. The optical dimensions of the arc consequently increas and hence the concentrability decreases. On the other hand, in the case of an only locally thickened wall the manufacture is considerably more complicated and correspondingly more expensive.

The molding can consist of a ceramic part, which remains pressed against the wall of the discharge vessel with the aid of supporting means. For example, a dimming hood of car headlight lantern may serve as supporting means.

Figure 2:
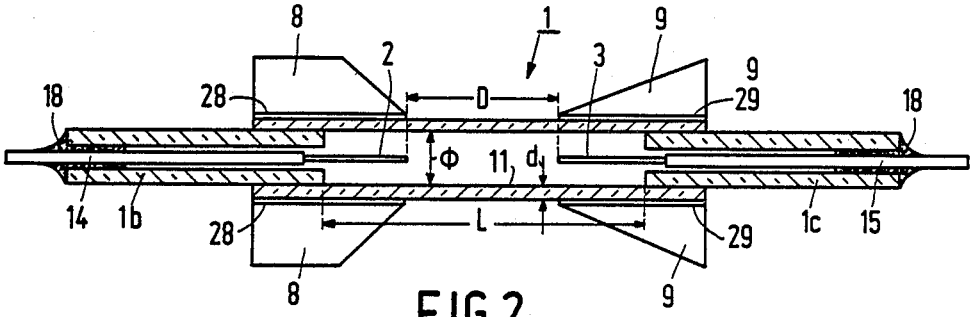
Figure 3:
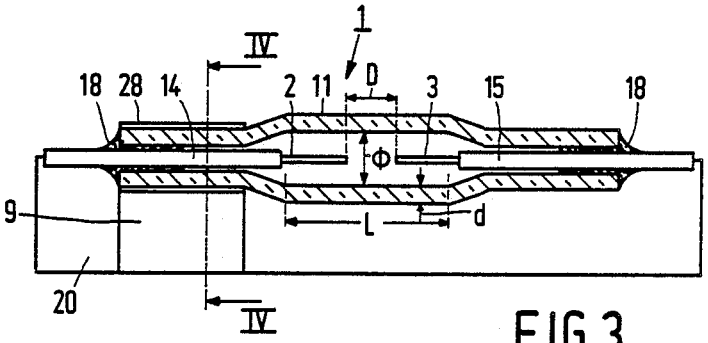
Figure 4:
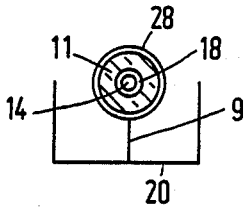
Figure 5:
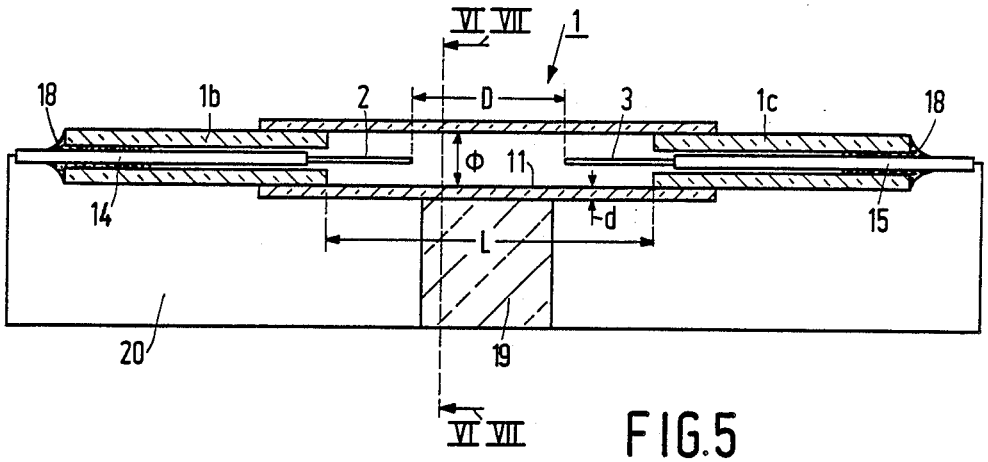
Figure 6:
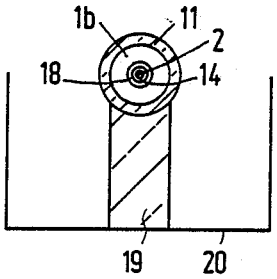
Figure 7:
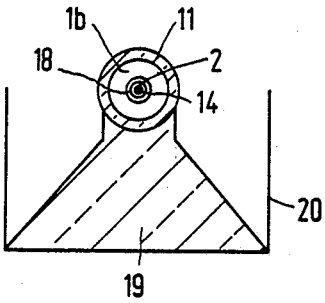

Embodiments of the lamp according to the invention are shown in the drawing. In the drawing:

FIG. 1 is a side elevation of a lamp with an outer envelope;

FIG. 2 is a longitudinal sectional view of a lamp;

FIG. 3 is a longitudinal sectional view of another lamp;

FIG. 4 is a sectional view of the lamp shown in FIG. 3;

FIG. 5 is a longitudinal sectional view of another lamp;

FIG. 6 is a sectional view of the lamp shown in FIG. 5;

FIG. 7 shows a variation of a sectional view of the lamp shown in FIG. 5.

Figure 8:
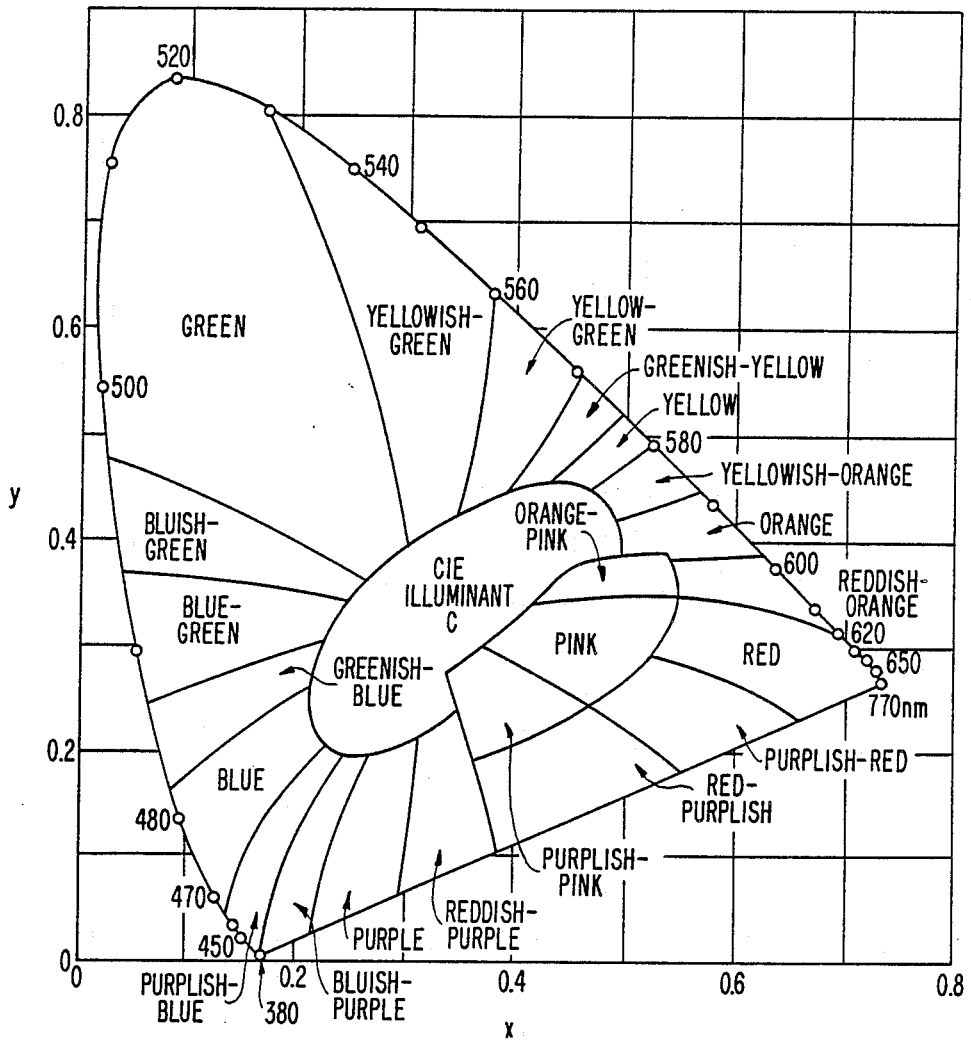

FIG. 8 is a reproduction of the C.I.E. chromaticity diagram.

DETAILED DESCRIPTION OF THE PREFERRED EMBODIMENTS

In FIG. 1, the lamp has an elongate ceramic discharge vessel 1, which has over a length L an at least substantially constant inner diameter $\phi$ and a substantially constant wall thickness d. Electrodes 2, 3 are arranged with their tips opposite to each other in the discharge vessel at a relative distance D. Each electrode 2, 3 is connected to a current supply conductor 4, 5, which is passed to the exterior near an end of the discharge vessel. The discharge vessel 1 is provided near each of its ends with a number of substantially radially projecting mouldings in the form of wings 8 and 9. The discharge vessel 1 is filled with sodium, mercury and rare gas. The discharge vessel 1 is arranged in an outer envelope 6 having a lamp cap 7, to which the current supply conductors 4, 5 are connected. The nominal power of the lamp is at most 50 W and the light emitted by the lamp during operation has a color temperature of at least 2250K.

In FIGS. 2 to 7, parts corresponding to FIG. 1 have corresponding reference numerals.

The embodiment of the discharge vessel 1 shown in FIG. 2 comprises a part 11 having a constant inner diameter $\phi$ and wall thickness d, in which projecting closing plugs 1*b*, 1*c* are sintered at the ends. A current supply conductor 14, 15 is passed through each plug 1*b*, 1*c* and is secured in a gas-tight manner to the closing plug by means of a sealing ceramic 18. The part 11 of the discharge vessel 1 is provided near the ends with an outer shield 28, 29, to which are secured radially projecting moldings or fins, 8, 9 in the form of wings.

In the embodiment shown in FIG. 3, the discharge vessel 1 comprises a cylinder consisting of polycrystalline aluminium oxide and having a varying inner diameter. The part 11 having a constant inner diameter $\phi$ has a length L and a wall thickness d. At one end the discharge vessel is surrounded by a shield 18, to which a molding 9 in the form of a wing is secured. The wing 9 bears on a metal screening hood 20, as shown in FIG. 4.

In the embodiment shown in FIG. 5, the lamp is provided with a dimming hood 20. A ceramic molding 19 is pressed between the dimming hood 20 and the part 11 of the discharge vessel. FIG. 6 is a sectional view taken on the line VI—VI of the dimming hood 20, the molding 19 and the discharge vessel 1. FIG. 7 is a secional view with a variation of the ceramic molding 19.

In the lamp having a discharge vessel according to the embodiment shown in FIG. 2, the inner diameter $\phi$ was 1.7 mm, the wall thickness d was 0.45 mm, the length D between the electrode tips was 4.8 mm and the length L over which the discharge vessel has a constant inner diameter $\phi$ was 17 mm. The electrodes 2, 3 consisted of tungsten/rhenium pins (3% by weight of Re) having a diameter of 0.55 mm. The current supply conductors 14, 15 consisted of niobium. The discharge vessel was filled with Na/Hg=15/40 (weight/weight) and Xe at a pressure of 120 kPa at 300K. The shields 28, 29, like the wings 8, 9, consisted of tantalum. The color temperature of the light emitted by the lamp was 2400K; the efficiency was 44 lm/W. The optical dimensions of the light source were:

optical diameter 1.4 mm, optical length 5.1 mm.

For the optical diameter the largest width of the luminance pattern of the light source is chosen at a value amounting to 20% of the maximum luminance, measured at right angles to the longitudinal direction of the luminance pattern. For the optical length the largest length of the luminance pattern of the light source is chosen at a value amounting to 20% of the maximum luminance, measured in the longitudinal direction of the luminance pattern. The maximum luminance was 38,000 kCd/m$^2$. The lamp was provided with an outer envelope filled with nitrogen at a pressure of 950 mbar at 300K.

For different numbers of wings, in the lamp described the occurring maximum wall temperatures ($T_w$max) are measured. The overall surface area of the wings is kept substantially constant at 380 mm$^2$. The wing thickness was approximately 0.2 mm. As far as not stated otherwise, the wing surfaces are bare. The results are indicated in the table.

TABLE

| lamp | number of wings | Tw max (K) |
|---|---|---|
| 1 | 1 | 1564 |
| 2 | 2 | 1512 |
| 3 | 4 | 1487 |
| 4 | 4 (black) | 1356 |
| 5 | 0 | 1630 |
| 6 | 0 | 1630 |

For comparison, in the Table for lamp 5 the measured maximum wall temperature is stated in case the lamp is provided only with tantalum shields 28, 29. Furthermore, in case these shields are also absent, the maximum wall temperature is measured and stated in the table for lamp 6.

For comparison, the data of a lamp commercially available having a nominal power of 35 W (Philips SDW/T) are stated:

| | |
|---|---|
| efficiency | 40 lm/W |
| color temperature $T_C$ of emitted light | 2500 K |
| length D between the electrode tips | 13 mm |
| length L with constant inner diameter ø | 19 mm |
| inner diameter ø | 2.5 mm |
| wall thickness d | 0.7 mm |
| amalgam filling | Na/Hg = 15/40 weight/weight |
| Xe-pressure at 300 K | 53.3 kPa |
| maximum wall temperature $T_W$ max | 1450 K |

It is ascertained of a similar lamp that the maximum luminance is approximately 8600 kCd/m$^2$.

What is claimed is:

1. A high pressure sodium discharge lamp having a sealed ceramic discharge vessel having over a length L a substantially constant inner diameter $\phi$ and a substantially constant wall thickness d, discharge electrodes having electrode tips arranged in said constant diameter portion of said discharge vessel with said tips opposite to each other at a relative distance D, current supply conductors each connected to a respective discharge electrode and extending through the wall of the discharge vessel, a filling comprising sodium and a rare gas in said discharge vessel, said lamp consuming during operation a power of at most 50 W and emitting light having a color temperature of at least 2250K, and the ratio D/L having a value $D/L \leqq 0.5$, wherein the improvement comprises:

$(\phi+d) \leqq 2.5$ mm, and a fin in mechanical contact with said discharge vessel for controlling the maximum wall temperature of said discharge vessel.

2. A high pressure sodium discharge lamp as claimed in claim 1, further comprising a heat resistant shield surrounding the discharge vessel between an end of the discharge vessel and the adjacent electrode tip, and said fin forming part of said heat resistant shield.

3. A high pressure discharge lamp as claimed in claim 1, wherein said fin contacts said discharge vessel wall between said electrode tips.

4. A lamp as claimed in claim 1, wherein the discharge vessel is provided with two or more fins arranged symmetrically to the longitudinal axis.

5. A lamp as claimed in claim 3, characterized in that the lamp is suitable to be used as a car headlight lantern and in that a fin is connected to a dimming hood.

6. A lamp as claimed in claim 1, characterized in that the lamp is suitable to be used as a car headlight lantern and in that a fin is connected to a dimming hood.

7. A lamp as claimed in claim 2, characterized in that the lamp is suitable to be used as a car headlight lantern and in that a fin is connected to a dimming hood.

8. A high-pressure sodium discharge lamp having an operating power dissipation not exceeding 50 watts and emitting during operation white light having a color temperature of at least 2250° K., said lamp comprising:

a sealed ceramic discharge vessel having over a length L a substantially constant inner diameter $\phi$ and a substantially constant wall thickness d, a pair of pin electrodes disposed within said discharge vessel and spaced at opposite ends of the constant diameter portion of said discharge vessel to define a discharge gap of length D between them having a value between about 3 mm and 13 mm, the ratio D/L having a value from about 0.15 to about 0.5 selected to optimize the lamp in terms of efficiency and maintenance;

a pair of current-supply conductors each connected to a respective pin electrode and extending through said discharge vessel for permitting supply of electrical current to said pin electrodes;

a quantity of sodium and a rare gas within said discharge vessel;

the sum of the inner diameter and the wall thickness $(\phi+d) \leqq 2.5$ mm, and a fin in contact with said discharge vessel extending substantially radially from said discharge vessel, said fin being selected such that the maximum wall temperature of said discharge vessel during normal lamp operation is less than about 1570° K.

9. A high pressure sodium discharge lamp as claimed in claim 8, further comprising a heat resistant shield surrounding the discharge vessel between an end of the discharge vessel and the adjacent electrode tip, and said fin forming part of said heat resistant shield.

10. A high pressure discharge lamp as claimed in claim 8, wherein said fin contacts said discharge vessel wall between said electrode tips.

11. A lamp as claimed in claim 8, wherein the discharge vessel is provided with two or more fins arranged symmetrically to the longitudinal axis.

12. A lamp as claimed in claim 8, characterized in that the lamp is suitable to be used as a car headlight and in that a fin is connected to a dimming hood.

13. An optimized high-pressure sodium discharge lamp having a reduced dimension of the discharge arc at a given power and color temperature, said lamp comprising:

a sealed ceramic discharge vessel having over a length L a substantially constant inner diameter $\phi$ and a substantially constant wall thickness d, a pair of pin electrodes disposed within said discharge vessel and spaced at opposite ends of the constant diameter portion of said discharge vessel to define a discharge gap of length D between them;

the ratio D/L having a value $0.15 \leqq D/L \leqq 0.5$;

a quantity of sodium and rare gas within said discharge vessel selected such that said lamp emits white light having a color point within the region of the C.I.E. chromaticity diagram bounded by the lines $x=0.468$, $x=0.490$, $y=0.408$ and $y=0.425$, a general color rendering index $Ra_8 \geqq 75$ and a color temperature between about 2250° K.to about 2750° K., and said lamp dissipating no more than 50 watts during operation;

a pair of current-supply conductors each connected to a respective pin electrode and extending through said discharge vessel for permitting supply of electrical current to said pin electrodes; and a fin in contact with said discharge vessel and extending substantially radially from said discharge vessel, said fin being selected such that the maximum wall temperature of said discharge vessel during normal lamp operation is less than about 1570° K.

14. A high pressure sodium discharge lamp as claimed in claim 13, further comprising a heat resistant shield surrounding the discharge vessel between an end of the discharge vessel and the adjacent electrode tip, and said fin forming part of said heat resistant shield.

15. A high pressure discharge lamp as claimed in claim 13, wherein said fin contacts said discharge vessel wall between said electrode tips.

16. A lamp as claimed in claim 13, wherein the discharge vessel is provided with two or more fins arranged symmetrically to the longitudinal axis.

17. A lamp as claimed in claim 13, characterized in that the lamp is suitable to be used as a car headlight and in that a fin is connected to a dimming hood.

* * * * *